US005181570A

United States Patent [19]

Allwin et al.

[11] Patent Number: 5,181,570

[45] Date of Patent: Jan. 26, 1993

[54] LINER HANGER ASSEMBLY

[75] Inventors: Roger P. Allwin, Bryan, Tex.; James W. Agnew, Oklahoma City, Okla.

[73] Assignee: MWL Tool Company, Houston, Tex.

[21] Appl. No.: 609,104

[22] Filed: May 10, 1984

[51] Int. Cl.[5] ..... E21B 19/00

[52] U.S. Cl. ..... 166/381; 166/208; 166/217

[58] Field of Search ..... 166/381, 382, 206, 208, 166/216, 217

[56] References Cited

U.S. PATENT DOCUMENTS

| | | | |
|---|---|---|---|
| 2,362,766 | 11/1944 | Morgan | 166/208 |
| 2,373,880 | 4/1945 | Driscoll | 166/208 |
| 3,171,490 | 3/1965 | States | 166/208 X |
| 3,456,723 | 7/1969 | Current et al. | 166/217 X |
| 4,010,804 | 3/1977 | Garcia | 166/208 |
| 4,033,640 | 7/1977 | Garcia | 175/337 |
| 4,176,715 | 12/1979 | Bigelow et al. | 166/138 |
| 4,190,300 | 2/1980 | Scalzi | 308/4 A |

*Primary Examiner*—William P. Neuder

[57] ABSTRACT

A liner hanger and setting tool in which the liner hanger has an expander cone with a rotational clearance space relative to a suporting member and a low friction contacting surface for alleviating binding and frictional forces on the supporting member and where the liner hanger has spaced apart spline housings which cooperate with spline keys on a setting tool to determine rotational torque prior to and during cementing operations and where the release of the setting tool from the liner hanger can be determined prior to cementing.

24 Claims, 3 Drawing Sheets

FIG.1
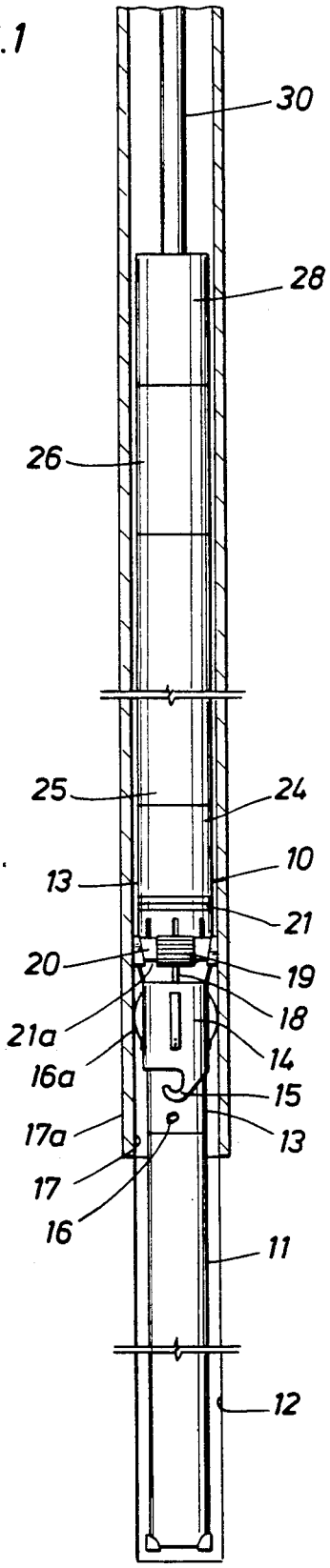
FIG. 4
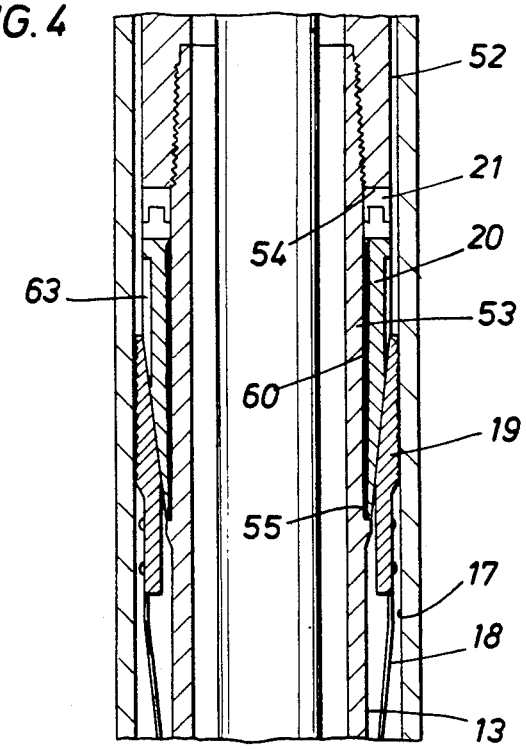
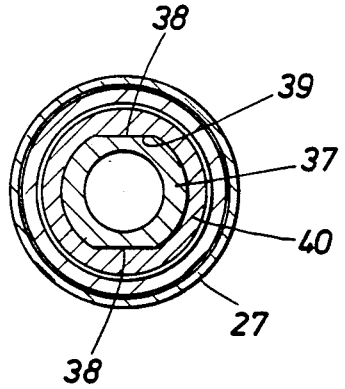
FIG.5
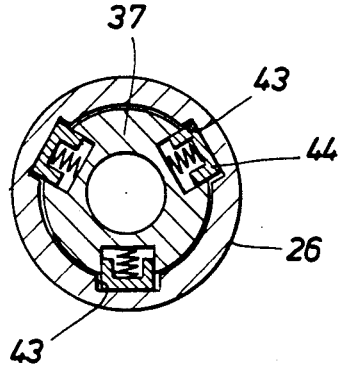
FIG. 6

LINER HANGER ASSEMBLY

BACKGROUND OF THE INVENTION

1. Field of the Invention

This invention concerns liner hangers, methods for hanging a liner casing in a well bore, and methods for manipulating a liner casing during a cementing operation. More specifically, the present invention concerns apparatus and methods for use in rotating a liner casing in a well bore during cementing operations.

2. The Prior Art

In well drilling and completion operations, after the borehole is drilled, a tubular liner casing is positioned in the well bore and the annulus between the liner casing and well bore is filled with cement. The liner casing cementing operations are conducted by running the liner casing in the well bore by means of a setting tool and a drill string or string of tubing where the setting tool interconnects the drill string and the liner casing. The liner hanger (attached to the upper end of the liner casing) is set in the well bore at a desired location so that the weight of the liner casing is supported by the liner hanger. Next, cement is introduced through the drill string and through the liner casing and flows out of the bottom of the liner casing into the annulus between the liner casing and the well bore. After filling the annulus with cement, the setting tool is released from the liner casing and retrieved with the drill string.

The liner casing is set or suspended by a liner hanger at a location in the well bore so that the end of the liner casing extends to close proximity to the bottom of the drilled well bore. At the lower end of the liner casing is a cement shoe with several orifices through which cement is introduced to the annulus between the liner casing and the borehole.

The cement slurry which is introduced to the annulus moves upwardly in the annulus between the liner casing and the well bore. As the cement slurry travels upwardly in the annulus, it displaces the drilling mud in the well bore above the cement.

If the liner casing is reciprocated and/or rotated during the cementing operation, this movement will greatly assist the obtaining of a uniform distribution of the cement in the annulus and proper displacement of the drilling mud in the annulus without channeling of the cement through the mud. In order to rotate the liner casing during the cementing operation, the drill string must be connected to the liner casing and to the liner hanger so that rotation of the drill string causes the liner casing to be rotated relative to the liner hanger until after the cementing operation is complete. Thereafter, the drill string is released from the liner hanger and is pulled out of the well leaving the liner casing cemented in place.

When the liner hanger for the liner casing is set in the well casing, it is set so the bottom of the cement shoe is just above the bottom of the borehole to eliminate the possibility of fouling of the cement shoe orifices and to leave the liner casing pipe hanging under its own weight from the next above well casing. As may be appreciated, the operation requires considerable care because once the cementing is complete, the liner casing pipe cannot be removed and repositioned since the cement is already in place. Also, if the releasing mechanism in the liner hanger fails to disengage from the drill string prior to the cement hardening up, the drill string could also be cemented in place. Such malfunctions can result in the loss of well equipment in the well or even destroying the well. Also, if the drill string is released from the liner casing prior to pumping cement, then reciprocation or rotation of the liner casing during the cementing operations is not possible since the drill string must be attached to the liner casing pipe to move it. Thus, the advantages of reciprocating and rotating of the liner casing pipe during the cementing operation are lost.

It has been proposed to incorporate in a liner hanger, a rotatable bearing between horizontal load bearing surfaces in the liner hanger so that when the liner hanger is set and the liner casing suspended from the next above string of well pipe, the liner casing is supported in the liner hanger on a rotational bearing. The rotational bearing then facilitates rotation of the liner casing relative to the liner hanger after setting the liner hanger. However, in many wells, the weight of the suspended liner casing subjects the rotational bearing to excess stress and the bearing wears out rapidly. Also, exposure of the bearing to the well bore environment also causes excessive wear of the bearing. If the bearing malfunctions, then the casing liner may not be rotated during cementing. It is virtually impossible for the operator at the surface to have any qualitative indication of the downhole operations.

Examples of rotatable load bearing bearings and liner hangers are shown in U.S. Pat. No. 4,033,640 and U.S. Pat. No. 4,190,300.

Despite use of rotatable bearings in liner hangers, the torque required to rotate a liner in a borehole often has been excessive to the point of twisting off or breaking the pipe downhole. At the earth's surface, it is difficult for the operator to determine whether this excessive drag in the borehole is a result of poor operation of the rotatable bearing or simply high pipe friction in the well bore due to a crooked or tight hole. A third source of excessive drag in the borehole is the result of high contact forces between the contacting surfaces of the stationary slip cone member and the liner hanger mandrel which is in rotating contact with the slip cone member.

The present invention provides a unique system for the operator to determine downhole drag characteristics prior to cementing, either before and/or after the liner is suspended. The invention further provides an apparatus that minimizes frictional drag associated with the high contact loading between the contacting surfaces of the cone and liner hanger body.

SUMMARY OF THE INVENTION

The present invention involves a liner hanger and setting tool for well cementing operations wherein the liner hanger which is connected to a liner casing is provided at its upper end with a setting tool housing having upper and lower splined sections and an upper threaded connection for a setting tool. The setting tool is adapted for connection with a tubing string or drill string and has a spline lug assembly between a lower sealing assembly and an upper release nut where the release nut is adapted to connect to the threaded connection on the setting tool housing. The setting tool interconnections with the setting tool housing permit the liner hanger slips to be released from a retracted, going-in position. Prior to moving the released liner hanger slips to a set position, the liner hanger mandrel and liner casing can be rotated by the tubing string to determine the downhole drag of the liner casing in the well bore before the slips are set in position. By manipulation of the tubing string, the liner hanger slips on the liner hanger are then set with respect to the borehole casing and a surface indication is provided to the operator of the success of the setting operation. After setting the slips, the tubing string and the liner casing can be rotated to determine the drag of the liner casing in the borehole when the slips are set. Next, a release nut on the setting tool is threadedly disengagable from the setting tool housing by rotation so that the entire setting tool can be pulled out of the setting tool housing on the liner hanger prior to cementing. This assures the operator at the surface that the setting tool is releasable from the setting tool housing prior to cementing. The setting tool is then re-engaged (or may be set on the top of the setting tool housing) and a lower spline section in the setting tool housing cooperates with the setting tool to provide a drive mechanism to rotate the liner casing and to permit the measurement of the torque values during the cementing operation.

The liner hanger has a rotational bearing as well as an expander cone where the expander cone has a bore sized relative to the liner hanger mandrel so that the expander cone can be compressed and absorb in compression a part of the liner hanger weight without applying the entire effect of the liner hanger weight on the hanger mandrel. A low friction coating or surface facing is disposed between the contactable surfaces of the supporting hanger mandrel and the expander cone to facilitate or ease the frictional relationship therebetween by reducing the coefficient of friction therebetween and thereby to enhance the rotational interrelationship. It is the combined effects of the low friction coating or surface and the clearance space between contactable surfaces under load that provide this rotational system with superior rotating characteristics for cementing a liner casing in a well bore.

IN THE DRAWINGS

FIG. 1 is an overall schematic view of a liner hanger disposed in a well bore;

FIG. 4 is a view in longitudinal cross-section of the expander cone as related to the supporting member to facilitate ease of rotation.

FIG. 5 is an enlarged view in cross-section taken along line 5—5 of FIG. 2A; and FIG. 6 is an enlarged view in cross-section taken along line 6—6 of FIG. 2A.

DETAILED DESCRIPTION OF THE INVENTION

Figure 2A:
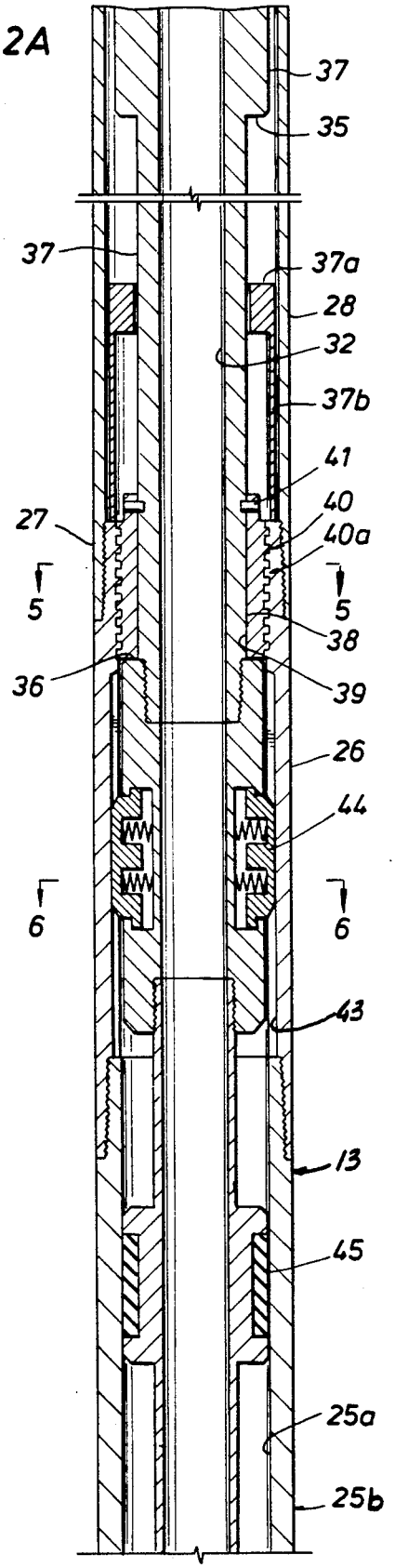
FIGS. 2A and 2B are views in longitudinal cross-section of the liner hanger and setting tool in a going-in position.

Referring now to FIG. 1, a liner hanger assembly 10 is shown in a set position in a well casing. The liner hanger assembly 10 is coupled to a lower depending liner casing or liner 11 to be cemented in a well bore 12 below the liner hanger assembly 10. The liner hanger assembly 10 includes a tubular hanger mandrel 13 which is coupled by a threaded connection to the liner casing pipe 11. The tubular mandrel 13 carries at its lower end, a tubular J-slot sleeve or cage 14 which has J-hooks 15 which are adapted to be releasably connected with respect to J-pins 16 on the mandrel 13. The tubular cage 14 has external friction pads or springs **16*a* which frictionally engage the wall 17 of the next above casing 17*a* and prevent the cage 14 from relative rotational movement during the latching or unlatching of the J-pins 16 from the J-hooks 15. The J-cage 14 is attached by longitudinally extending straps 18 to slip members 19 which are circumferentially disposed about the periphery of the mandrel 13. The slip members 19 have inner tapered surfaces which slide upon an inclined expander cone 20. The expander cone 20 is rotatively mounted on the mandrel 13 between a lower stop shoulder 21*a* and an upper rotatable bearing 21**.

The mandrel 13 of the liner hanger assembly 10 at its upper end has a tubular coupling sub 24 connected to a lower spline housing 25. A tubular extension **25*b* interconnects the lower spline adapter housing 25 to an upper spline adapter housing 26. The spline adapter housing 25 contains lower spline grooves 49 and the spline adapter housing 26 contains upper spline grooves 43. The upper housing 26 is connected to a tubular protection pipe or sleeve 28. The drilling pipe 30 and setting tool, which is utilized for rotating the liner casing pipe 11, is releasably connected by a rotatable nut 40 to the spline adapter housing 26 through setting thread 40*a* contained in the top of spline adapter housing 26** (See FIG. 2A).

Figure 2B:
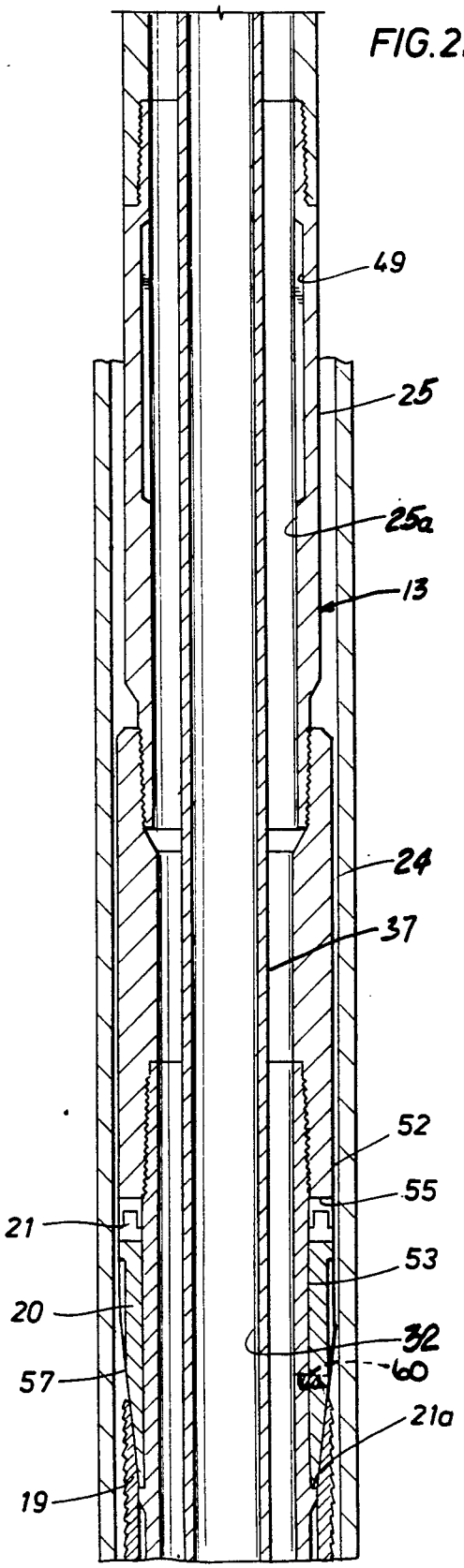

The lower end of a drill string 30 which is connected to the setting tool includes a tubular member 37 with an internal bore 32 (See FIGS. 2A and 2B). The tubular member 37 may be constructed of several interconnected tubular members, the member 37 being shown in a unitary construction for ease of illustration. At the lower end of the tubular member 37 is a conventional liner wiper plug catcher (not shown).

The tubular member 37 has an external upper, downwardly facing shoulder 35 which is adapted to engage the upper surface **37*a* of a tubular nut cover 37*b* for applying a downward force to the setting tool housing which connects to the mandrel 13. Below the shoulder 35, the tubular member 37 has diametrically opposed flattened surfaces 38 (See FIG. 5), which extend lengthwise along the tubular member 37 to form a spline. The flattened surfaces 38 of the member co-operate with internal flattened surfaces 39 on the rotatable nut 40 for rotation of the nut 40 (See FIG. 5) while permitting relative longitudinal movement. The releasable nut 40 is initially releasably attached to the tubular member 37 by shear pins 41, which initially prevent relative longitudinal motion between the nut 40 and the tubular member 37 until after the shear pins 41** are sheared.

When the spline lugs on the setting tool are disengaged from the splines on the setting tool housing, rotation of the tubular mandrel 37 relative to the spline housing 26 produces rotation of the nut 40 so that the external threaded portion on the nut 40 can be unscrewed from the setting thread **40*a* inside of the spline adapter housing 26. The member 37 has an upwardly facing shoulder 36 which is suitably spaced from the upper shoulder 35 to permit relative longitudinal movement sufficient to cause spline engagement as necessary. The shoulder 36 is adapted to engage the lower end of the traveling nut 40 so that when the nut 40 is released from the spline adapter coupler 26, the nut 40 can be moved upwardly with the tubular member 37. Above the nut 40 is the nut cover 37*b* which is internally sized to receive the nut 40 when the nut is released and which provides the flange surface 37*a* to transmit force from shoulder 35 directly to the spline adapter housing 26 without destroying or affecting the nut 40**.

Below the threads 40*a*, the spline adapter housing 26 has three circumferentially arranged, longitudinally extending, internal spline grooves 43 (See FIG. 6). The tubular member 37 has spring biased spline lugs or key members 44 which are resiliently biased outwardly by spring members. The key members 44 are arranged to engage with the spline grooves 43, as illustrated in FIGS. 2A and 6, when the member 37 is in an upper position before the shear pins 41 are sheared. The spline housing 26 and the spline housing 25 have a smooth bore portions 25*a*. In the position shown in FIG. 2A, the bore of the housing 25 sealably engages the tubular member 37 thru an annular pack-off means 45. In the position shown in FIG. 2A, rotation of the drill string 30 rotates the tubular member 37 and the interconnected spline adapter housing 26 thus obtaining rotation of the mandrel 13 and the liner casing 11 (while the liner hanger is unset and suspended from the tubular member 37).

When the tubular member 37 is moved longitudinally downward with respect to the spline adapter housing 26, the key members 44 are biased inwardly to permit downward travel of the member 37 through spline housing 26 and through the housing 25.

Figure 3A:
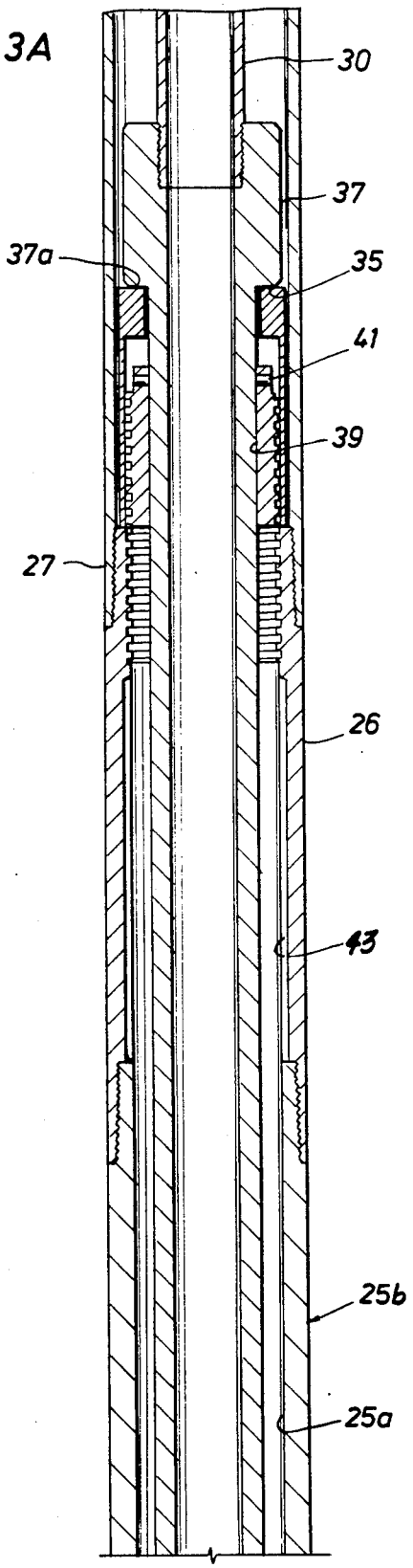
FIGS. 3A and 3B are views in longitudinal cross-section of the liner hanger and setting tool in a set position of the liner hanger for rotation of the liner casing.
Figure 3B:
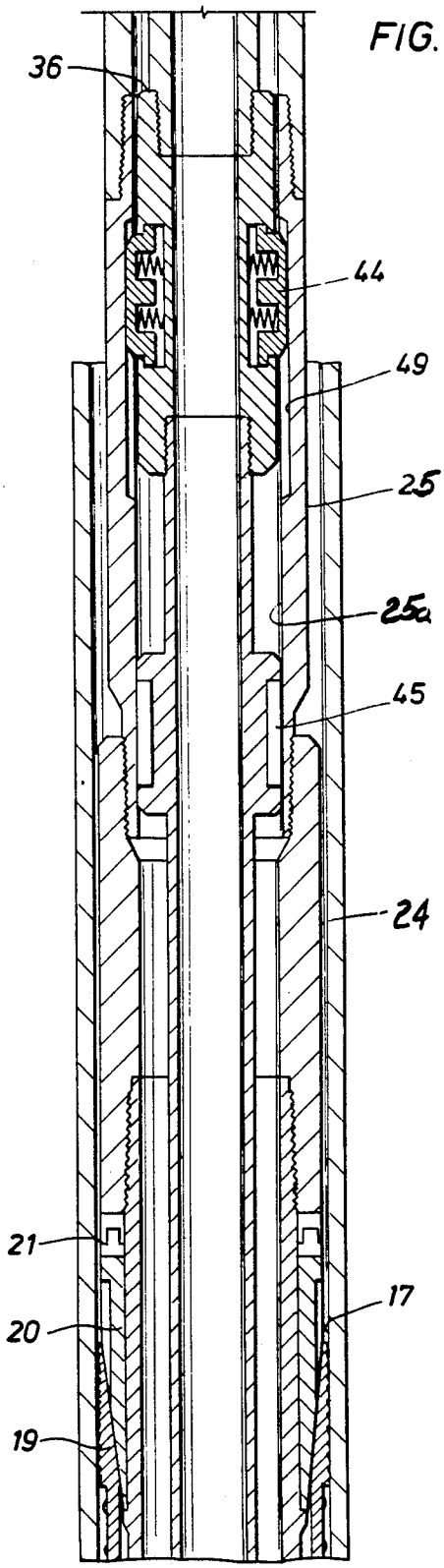

When the key members 44 are at the lower end of the spline adapter housing 25, three circumferentially arranged longitudinally extending spline grooves 49 are adapted to receive the key members 44. FIGS. 3A and 3B depict the tubular member 37 in a lower position where the shear pins 41 have been sheared and the tubular member 37 has been moved downwardly to position the keys 44 adjacent to spline grooves 49. In the lower position of the member 37 as shown in FIGS. 3A and 3B, rotation of the member 37 produces rotation of the mandrel 13 through the splines 44 and spline grooves 49. Also, in the lower position of member 37, the shoulder 35 engages the shoulder 37*a* and the pack-off housing 45 sealingly engages the bore 25*a* in the housing 25.

Referring back to FIG. 2B, the mandrel 13 on the bottom of the tubular coupling sub 24 has a downwardly facing shoulder 55, and an interconnected tubular member has an upwardly facing annular flange or stop shoulder 21*a*. Between the shoulder 55 and the shoulder 21*a*, a rotatable bearing 21 and a tubular slip expander or cone element 20 are rotatably mounted. The slip expander 20 has a downwardly tapered conical portion or cone surface 57 which is adapted to cooperate with the tapered slip engaging members 19. As shown in FIGS. 3A and 3B, when the expander cone 20 is moved downwardly relative to the slip engaging members 19, the slip engaging members 19 are brought into gripping engagement with the wall 17 of a well casing. The bearing 21 may be of the type referred to in the U.S. patents referenced above.

Referring now to FIG. 4, the slip expander element 20 is shown enlarged relative to the mandrel 13 to illustrate that the inner cylindrical surface 60 of the expander element 20 is coated with a low friction material which is thereby incorporated with the surface 60. Between the surface 60 and the outer surface of the mandrel is a clearance space spacing dimension in the range of 0.005 to 0.020 inches. The outer periphery of the cylindrical portion of the expander element 20 is provided with eight longitudinal grooves 63 spaced at 45° from one another about the circumference of the expander.

The purpose of the clearance space between the slip expander element 20 and the mandrel 13 is to permit setting of the slip elements 19 and carrying the weight load of the liner casing so that the expander cone can compress in absorbing the weight load before contacting the mandrel surface. The low friction material facilitates rotation after contact of the expander and mandrel surfaces so that the mandrel 13 can be rotated relative to the expander element 20 and the bearings 21 after the slips are set. While a range of clearance is set forth herein, the clearance should not be so great as to cause clogging or binding by particulate matter in the well bore fluid, nor should the clearance be too small to cause binding. Thus, in some cases, the clearance can be very small. The clearance may vary from size to size of liner hangers as the weight load varies. Similarly, the low friction coating may vary in thickness relative to the required clearance space. The coating can be in various forms which attach to the surface of either the expander or the mandrel and may be impregnated in the part, or one of the surfaces may be constructed from a low friction material. The low friction material should have a low compressive strength. Grease or other suitable filler can be utilized to fill the clearance space for limited lubrication but principally for preventing clogging by well bore materials.

As shown dashed line at 60 in FIG. 2B, a shear pin may be used to temporarily key the cone and mandrel to one another to prevent relative rotation for release of the J-pins from the J-hooks.

Referring now to FIGS. 2A and 2B, the well tool is shown in a going-in position where the slip members 19 are held in an un-set position relative to the expander cone 20 by the J-pins 16 engaging the J-hooks 15 in the cage 14 (See FIG. 1). The tubular member 37 of the setting tool has the spline keys 44 engaged with the spline grooves 43 and is connected by shear pins 41 to the traveling nut 40. The tool is run into the well to the depth where the linear hanger is to be set. During this entire operation, the tool is under a state of tension because of the weight of the casing linear below the linear hanger. At the desired location, the drill string 30 is picked up, rotated to the right and lowered to release the J-pin 16 from the J-hooks 15. Before the drill string 30 is lowered sufficiently to set the slip elements, the drill string 30 is rotated and the torque required to rotate the linear casing in the hole before the slips are set is noted by the driller. Next, the drill string 30 is lowered until the expander 20 engages the slip elements 19. This brings the slip expander under the slip element means and brings the slips into gripping engagement with the wall of the casing so that the slips are set and carry the weight of the linear casing. Upon continued downward force on the drill string 30, the shear pins 41 fracture at a predetermined value. The shearing of the pins 41 is observable by the driller at the surface by the sudden movement of the drill string 30. By shearing of the pins 41, the operator can determine that the slips are set and that the setting string of tubing is now longitudinally movable with respect to the linear hanger. All the linear weight is now borne by the slips and removed from the setting tool string of tubing but the setting tool is connected to the linear hanger by the nut 40. Next, the operator lowers the string of tubing 30 until shoulder 35 contacts shoulder 37*a* of nut cover 37*b* leaving keys 44 engaged with lower spline grooves 49. Again the drill string linear assembly is rotated and another torque reading can be made at the surface to determine how much drag results from the load applied to expander 20 and bearing 21. In other words, how much drag there is before cementing with the slips being set. Next, the operator raises the keys 44 into a neutral position in spline adapter housing 26 and rotates the tubing string to unthread the nut 40 from the spline adapter housing 26. When the nut 40 is released, the drill string 30 is raised to disengage the setting tool from the liner hanger. Thus, the operator can determine that the setting tool can be properly released from the liner hanger prior to the cementing operation. Next, the drill string is lowered to a neutral position of the spline lugs and the nut 40 reconnected. The key members 44 are then disposed in the lower spline grooves 49, by the lowering of the drill string. At this time the sealing assembly 45 is in the bore 25*a*. The operator then again may rotate the drill string 30 and rotate the liner casing 11 in the well bore while the liner is set on the bearing 21. The torque required to rotate the liner casing with the slip elements set and prior to the cementing opertion again can be determined and noted. Following this, the cement can be introduced through the drill string 30 and pumped down through the string and into the annulus between the liner casing and the well bore. At the same time, the casing liner 11 can be rotated by the interconnection of the spline lugs with the lower spline housing to enhance the cementing operation.

In summary of the operation,

1) The assembled liner hanger and setting tool are lowered into a well casing on a tubing string 30 to the location where it is desired to set the liner hanger.

2) The slip elements 19 on the cage 14 are released with respect to the mandrel 13 by unjaying the J-pins 16 from the J-hooks 15.

3) Before setting the slip elements and while the pins 16 are free of the hooks 15, the tubing string 30 is rotated to obtain an initial torque reading of the drag of the liner casing pipe prior to setting the liner hanger.

4) Next, the hanger slips are set as the tubing string 30 is moved downwardly and the pins 41 in the traveling nut 40 to indicate the slips are set. Next the shoulder 35 applies force through the housings and mandrel 13 to additionally set the slip elements. The shearing of the pins 41 is an observable event at the surface so that the operator knows the slips are engaged and accepting the liner weight.

5) Next, the key assembly on the tubular member 37 is lowered in the spline adapter housing so that the key members 44 engage the lower splines 49 and the tubing string 30 is rotated. The operator notes the torque required to rotate the liner casing with the slip elements set.

6) After setting the slip elements, the tubing string is raised to a neutral position and the setting tool is rotated to back the nut 40 out of the liner hanger to assure the operator that the setting tool is releasable from the liner hanger before the cementing operation occurs.

7) Next, nut 40 is reconnected and then the key members are engaged with the lower spline housing. Following this, the cement is introduced through the tubing string 30 and the liner casing 15 is rotated during the cementing operation.

8) After the cementing operation is completed the setting tool is easily removable by disconnecting the nut and an upward pull on the tubing string 30.

It is noted that reconnection of the nut 40 during the operation is optional.

During the cementing operation, the operator can note the torque required to rotate the liner casing. This torque will be comparable to the torque required to rotate the liner hanger in step 5 as in step 5 the liner hanger is set and rotation is carried by the rotational bearings 21 and the rotation of the tubular member 13 under the expander cone 20.

In the relationship of the expander cone 20 to the tubular member 13, the annular spacing or clearance permits compression of the expander cone 20 under a setting load on the slip elements and minimizes seizing of the expander cone on the mandrel. The low friction coating which can be teflon provides a lubrication effect to enhance the ability to obtain relative rotational movement between the expander cone and the tubular member after the slips are set and the expander cone contacts the mandrel surface. The size of the clearance space is a function of the materials and the load expected so as to permit compression of the expander cone yet avoid placing all of the compressive forces on the member 13. Thus, the expander cone 20 serves to absorb compressive forces without transferring the full effect of the compressive forces on the member 13.

It will be apparent to those skilled in the art that various changes may be made in the invention without departing from the spirit and scope thereof and therefore the invention is not limited by that which is enclosed in the drawings and specifications, but only as indicated in the appended claims.

We claim:

1. A method for setting a linear casing in a well bore and cementing comprising the steps of:

lowering a linear hanger in a well bore on a setting tool attached to a string of tubing to a desired location where the linear hanger has slip means releasably attached to a liner hanger mandrel and the slip means are movable from an unset position to a set position and where the linear hanger mandrel is attached to the liner casing and where the setting tool is releasably attached to the liner hanger mandrel, at the desired location in a well bore and prior to moving the slip means to a set position, rotating the liner hanger mandrel and liner casing and the string of tubing and determining the torque required at the earth's surface for rotating the liner casing in the well bore before the slip means are moved to a set position, releasing the slip means and moving the liner hanger-mandrel and slip means to s set position of the slip means where the slip means engage the well bore, obtaining a surface indication that the slip means are in a set position by applying a downward force to the string of tubing for operating a release mechanism in the setting tool and producing an observable longitudinal motion of the string of tubing at the earth's surface, rotating the liner hanger mandrel and the string of tubing while the slip means are in a set position and determining at the earth's surface, the torque required for rotating the casing liner with the slip means in a set position, maintaining the continuity of the bore of string of tubing, the setting tool and the liner hanger mandrel while rotating the setting tool, the liner hanger mandrel and the string of tubing and while passing cement through the bore of the string of tubing, the setting tool, and the liner hanger mandrel to introduce cement to the liner casing in a well bore while the liner casing is being rotated for cementing the liner casing in a wellbore.

2. A method for setting a liner casing in a well bore and cementing comprising the steps of:

lowering a linear hanger in a well bore on a setting tool attached to a string of tubing to a desired location where the linear hanger has slip means releasably attached to a liner hanger mandrel and the slip means are movable from an unset position to a set position and where the linear hanger mandrel is attached to the liner casing and where the setting tool is releasably attached to the liner hanger mandrel, at the desired location in a well bore and prior to moving the slip means to a set position, rotating the liner hanger mandrel and liner casing and the string of tubing and determining the torque required at the earth's surface for rotating the liner casing in the well bore before the slip means are moved to a set position, releasing the slip means and moving the liner hanger-mandrel and slip means to s set position of the slip means where the slip means engage the well bore, rotating the liner hanger mandrel and the string of tubing while the slip means are in a set position and determining at the earth's surface, the torque required for rotating the casing liner with the slip means in a set position, maintaining the continuity of the bore of string of tubing, the setting tool and the liner hanger mandrel while rotating the setting tool, the liner hanger mandrel and the string of tubing and while passing cement through the bore of the string of tubing, the setting tool, and the liner hanger mandrel to introduce cement to the liner casing in a well bore while the liner casing is being rotated for cementing the liner casing in a wellbore.

3. A liner hanger apparatus for use in rotating a liner during the cementing of a liner in a well bore comprising:

liner hanger means having a tubular mandrel adapted for connection to a liner to be cemented in a well bore, slip means operatively associated with said liner hanger means for selectively engaging a well casing and for supporting said tubular mandrel and a liner to be cemented in a well bore, slip expander means for operating said slip means and for causing said slip means to engage a well casing, said slip expander means including a tubular slip expander cone having a cone bore defining an inner cylindrical surface, said expander cone being rotatably mounted with respect to said tubular mandrel where said tubular mandrel has an outer co-extensively extending cylindrical mandrel surface, said cone bore having a diametrical dimension which is larger than the diametrical dimension of the cylindrical mandrel surface for defining means providing an unrestricted spacing dimension between the inner cylindrical surface of the cone bore and the outer cylindrical mandrel surface where said spacing dimension is interrelated to the radial compression of said slip expander cone under the weight load of said tubular mandrel and a liner when said slip means support a liner in a well casing for absorbing such weight load in the radial compression of said slip expander cone and for isolating radial compression of said slip expander cone due to such weight load from the outer cylindrical mandrel surface thereby reducing the frictional load between the inner cylindrical surface of said slip expander cone and the outer cylindrical mandrel surface when the tubular mandrel is rotated relative to said slip expander cone.

4. The apparatus as defined in claim 3 and where said slip means operatively associated with said liner hanger means includes a J-slot and J-Pin for retaining said slip means in an unset and for release of said slip means upon relative longitudinal movement between said slip expander cone and said slip means, and means attached to said slip means for frictionally engaging a well casing.

5. The apparatus as defined in claim 3 (4) wherein one of cylindrical surfaces of said cone bore or said tubular mandrel has incorporated therewith (low) friction material means having a (low) compressive strength such that when (for providing for a low coefficient of friction when) said cylindrical surfaces are in contact with one another the (to further reduce) frictional drag between said cylindrical surfaces upon relative rotation is reduced.

6. The apparatus as defined in claim 5 wherein rotational bearing means are disposed between horizontal surfaces on said tubular mandrel and said expander cone for facilitating rotation therebetween.

7. The apparatus as defined in claim 3 wherein said spacing dimension is in the range of 0.005 to 0.020 inches.

8. The apparatus as defined in claim 3 and further including rotational bearing means disposed between horizontal surfaces on said tubular mandrel and said expander cone for facilitating rotation therebetween.

9. A liner hanger and setting tool apparatus for setting and rotating a liner during the cementing of a liner in a well bore comprising:

liner hanger means having a tubular liner hanger mandrel adapted for connection to a liner to be cemented in a well bore and slip means on said liner hanger means for selectively engaging a well casing and supporting said liner hanger mandrel and a liner in a well bore, slip expander means on said hanger means including a tubular expander cone rotatively mounted on said liner hanger mandrel and adapted for cooperation with said slip means in supporting the weight of said liner hanger mandrel and a liner casing, a housing including longitudinally spaced apart upper and lower internal spline sections and an internally threaded section, said housing being coupled to said liner hanger mandrel, a setting tool adapted for coupling to a string of tubing, said setting tool having a setting tool mandrel slidably and non-rotatably coupled with respect to an annular, externally threaded release nut where said release nut releasably couples said setting tool mandrel to said housing, said setting tool mandrel having an external spline lug means disposed below said release nut, and said spline lug means being adapted for engagement with the internal spline sections in upper and lower positions of said setting tool mandrel by longitudinal movement of said setting tool mandrel for rotating said housing by rotation of said setting tool mandrel in either the upper or lower positions and being adapted for rotation with respect to said housing when said setting tool mandrel is in a position intermediate of said internal spline sections.

10. The apparatus as defined in claim 9 and further including release means for releasably interconnecting said setting tool mandrel and said release nut and releasable, after the slip means engage a well casing upon the application of a downward force on said setting tool mandrel for permitting a sudden longitudinal movement of said setting tool mandrel relative to said release nut.

11. The apparatus as defined in claim 10 wherein said release means includes a shear pin.

12. The apparatus as set forth in claim 9 and further including a sealing bore disposed in said housing below said spline sections, and sealing means disposed on said setting tool mandrel in a slidable and sealing relationship with respect to a sealing bore.

13. The apparatus as set forth in claim 9 wherein rotational bearing means are disposed between horizontal surfaces said liner hanger mandrel and said expander cone for further facilitating relative rotation.

14. A liner hanger and setting tool apparatus for setting a liner in a well bore comprising:

liner hanger means having a liner hanger mandrel adapted for connection to a liner to be cemented in a well bore, slip expander means on said liner hanger mandrel, slip means on said liner hanger means for cooperating with said slip expander means for selectively engaging a well casing and supporting said liner hanger mandrel and a liner to be cemented in a well bore, said liner hanger mandrel having upper and lower internal spline groove means;

first interconnecting means for releasably interconnecting said liner hanger mandrel to said liner hanger means for retaining said slip means in an unset condition in one position and, upon release, for permitting said liner hanger mandrel to move relative to said slip means for bringing said slip means into engagement with a well casing, setting tool means adapted to be coupled to a string of pipe for operating said first interconnecting means, second interconnecting means releasably coupling said setting tool means to said liner hanger means, force releasable means in said setting tool means and interconnecting slidable components of said setting tool means and operable upon the application of a force to a string of pipe after said slip means are in engagement with a well casing to release and permit a relative sudden longitudinal movement in the setting tool means as an indication of engagement of the slip means with a well casing, means rotatively interconnecting said liner hanger mandrel and said slip expander means including an expander cone rotatively mounted on said liner hanger mandrel and adapted for cooperation with said slip means in supporting the weight of said mandrel and a liner, said setting tool having a setting tool mandrel slidably and nonrotatably coupled with respect to said second interconnecting means, said setting tool mandrel having an external spline lug means, and said spline lug means being adapted to selectively engage the upper and lower internal spline groove means in upper and lower positions of said setting tool mandrel for selectively rotating said liner hanger mandrel by rotation of said setting tool mandrel when in an upper or lower position said spline lug means and being adapted to rotate relative to said liner hanger mandrel in an intermediate position between said spline groove means.

15. The apparatus as set forth in claim 14 wherein rotational bearing means are disposed between said liner hanger mandrel and said expander cone for further facilitating relative rotation.

16. In an arrangement for supporting on a work string to rotate and reciprocate a liner before setting it by hanger means on a casing in a well bore and for rotating the liner after it is set on the casing wherein an outer member has a liner secured thereto, with hanger means supported on the other member for hanging the liner on the casing and bearing means on the outer member to accommodate rotation of (between) the outer member and liner relative to the casing and hanger means, and wherein an inner member is telescopically received in the outer member, the inner member having a noncircular mandrel connected with the work string, the invention including:

means on the inner and outer members to reciprocate and rotate the liner by manipulating the work string before the liner is set on the casing, said means to rotate being disengagable upon relative longitudinal movement between the inner and outer members after the liner has been hung;

means on said means to reciprocate for supporting the outer member and liner on the inner member, said means for supporting including thread means on the outer member and disengaging nut means threadedly secured on said thread means and telescopically receiving the mandrel whereby rotation of the work string after the liner is hung on the casing disconnects said disengaging nut from said thread means and disconnects the outer member from the inner member and work string; and additional means on the (inner and) outer member engagable with said inner member after the inner and outer members are disconnected from each other to rotate the outer member and liner relative to the hanger means and casing upon rotating the work string.

17. The invention of claim 16 wherein said additional means includes longitudinal slot means in the outer member and spring biased longitudinal key means on the inner member for engaging in said slot means upon lowering the work string.

18. The invention of claim 16 wherein said means to reciprocate before setting the liner includes shoulder means on said disengaging nut means and abutting shoulder means on the inner member.

19. The invention of claim 16 wherein said means to rotate before setting the liner includes longitudinal slot means in the outer member and spring biased longitudinal key means on the inner member engaged in said slot means.

20. The invention of claim 19 wherein said spring biased longitudinal key means include:

longitudinal slots in the inner member;

longitudinal key means for fitting in the longitudinal slots;

spring means in the slots abutting said key means to urge them outwardly of the slots; and keeper means on said inner body and overlapping said longitudinal keys to limit their outward movement and prevent their ejection from the longitudinal slots.

21. An arrangement for supporting on a work string to rotate and reciprocate a liner before setting it by hanger means on a casing in a well bore and for rotating the liner after it is set on the casing comprising:

inner and outer telescopically arranged members, said outer member having:

1. said liner secured thereto;
2. hanger means supported thereon; and
3. bearing means to accommodate rotation of said outer member and liner relative to the casing and hanger means;

said inner member having a noncircular mandrel connected with the work string;

means supporting the outer member and liner on the inner member, said means including:

1. thread means on the outer member; and
2. disengaging nut means threadedly secured on said thread means and telescopically receiving said mandrel whereby rotation of the work string disconnects said disengaging nut means from said thread means and releases the outer member from the inner member and work string;

means on the inner and outer members to reciprocate and rotate the liner by manipulating the work string before the liner is set on the casing;

said means to reciprocate before setting the liner including shoulder means on said disengaging nut means and abutting shoulder means on the inner member whereby the liner may be reciprocated in the well bore by raising and lowering the work string;

said means to rotate before setting the liner including first longitudinal slot means in the outer member and spring biased longitudinal key means on the inner member engaged in said slot means whereby the liner may be rotated by rotating the well string;

additional means on the outer member releasably engagable with said inner member after the inner and outer member are released from each other to rotate the outer member and liner relative to the hanger means and casing upon rotating the work string, said additional means including second longitudinal slot means in the outer member spaced longitudinally from said first slot means and engagable with said spring biased longitudinal key means on the inner member when the work string is manipulated to align said key means on the inner member with said second slot means.

22. An arrangement for supporting on a work string to rotate and reciprocate a liner before setting it by hanger means on a casing in a well bore and for rotating the liner after it is set on the casing comprising:

inner and outer telescopically arranged members, said outer member having:

1. a liner secured thereto;
2. hanger means supported thereon; and
3. bearing means to accommodate rotation of said outer member and liner relative to the casing and hanger means;

said inner member having a noncircular mandrel connected with the work string;

means supporting the outer member and liner on the inner member, said means including:

1. thread means on the outer member; and
2. disengaging nut means threadedly secured on said thread means and telescopically receiving said mandrel whereby rotation of the work string disconnects said disengaging nut means from said thread means and releases the outer member from the inner member and work string;

means on the inner and outer members to reciprocate and rotate the liner by manipulating the work string before the liner is set on the casing;

said means to reciprocate before setting the liner including shoulder means on said disengaging nut means and abutting shoulder means on the inner member whereby the liner may be reciprocated in the well bore by raising and lowering the work string;

said means to rotate before setting the liner including longitudinal slot means in the outer member and spring biased longitudinal key means on the inner member engaged in said slot means whereby the liner may be rotated by rotating the well string;

additional means on the outer member releasably engagable with said inner member after the inner and outer member are released from each other to rotate the outer member and liner relative to the hanger means and casing upon rotating the work string.

23. In an arrangement for supporting on a work string to selectively rotate and/or reciprocate a liner before setting it on a casing in a well bore and for rotating the liner after it is set on the casing wherein an outer member has a liner secured thereto and bearing means on the outer member to accommodate rotation between the outer member and liner relative to the casing and wherein an inner member is telescopically received in the outer member, the invention including:

means supporting the outer member and liner on the inner member;

means on the outer member to selectively engage with said inner member and rotate and/or reciprocate the liner by manipulating the work string before the liner is set on the casing; and additional means on the inner and outer members to rotate the outer member and liner after the liner is set on the casing.

24. A method of rotating and reciprocating a liner rotatably supported on a liner hanger that is releasably secured to a well string for lowering into a well bore having a casing, comprising the steps of:

lowering the liner hanger and the liner into the well bore;

lowering and rotating the well string to obtain the torque required to rotate the liner in the well bore;

determining the torque required at the earth's surface for rotating the well string and the liner in the well bore;

manipulating the well string to disconnect it from the liner hanger and to suspend the liner on the liner hanger in the casing;

lowering the well string to engage with the liner hanger and rotating the well string to rotate the suspended liner to obtain a torque measurement after the liner is suspended in the well bore; and rotating the well string after the liner is suspended in the well bore and determining at the earth's surface the torque required for rotating the well string and liner after the liner is suspended in the well bore.

* * * * *